US007673456B2

(12) United States Patent
Cameriano et al.

(10) Patent No.: US 7,673,456 B2
(45) Date of Patent: Mar. 9, 2010

(54) TURBOMACHINE COMBUSTION CHAMBER WITH HELICAL AIR FLOW

(75) Inventors: Laurent Bernard Cameriano, Avon (FR); Michel Pierre Cazalens, Bourron Marlotte (FR); Sylvain Duval, Tournan En Brie (FR); Romain Nicolas Lunel, Brie Comte Robert (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 12/137,863

(22) Filed: Jun. 12, 2008

(65) Prior Publication Data

US 2008/0307792 A1 Dec. 18, 2008

(30) Foreign Application Priority Data

Jun. 14, 2007 (FR) ..... 07 55761

(51) Int. Cl.
*F02C 3/00* (2006.01)

(52) U.S. Cl. ..... 60/746; 60/752

(58) Field of Classification Search ..... 60/752–760, 60/746, 747, 800; 439/9, 182, 183, 187, 439/350

See application file for complete search history.

(56) References Cited

U.S. PATENT DOCUMENTS 5,025,622 A * 6/1991 Melconian ..... 60/39.464
6,530,223 B1 3/2003 Dodds et al.
2005/0132716 A1 * 6/2005 Zupanc et al. ..... 60/804
2009/0056338 A1 * 3/2009 Cazalens et al. ..... 60/746

FOREIGN PATENT DOCUMENTS

EP 1 167 881 A1 1/2002
FR 2 695 460 3/1994

OTHER PUBLICATIONS

U.S. Appl. No. 12/199,116, filed Aug. 27, 2008, Cazalens, et al.

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, L.L.P.

(57) ABSTRACT

A turbomachine combustion chamber includes an inner annular wall, an outer annular wall surrounding the inner wall so as to co-operate therewith to define an annular space forming a combustion area, a plurality of fuel injector systems including pilot injectors alternating circumferentially with full-throttle injectors, and at least one air admission opening out into the upstream end of the combustion area in a substantially longitudinal direction. The outer wall has a plurality of pilot cavities extending between the two longitudinal ends of the outer wall and extending radially towards thereof, the pilot cavities being fed with air from outside the combustion chamber in a common substantially circumferential direction. Each pilot injector opens out radially into a pilot cavity, and each full-throttle injector opens out radially between two adjacent pilot cavities.

12 Claims, 4 Drawing Sheets

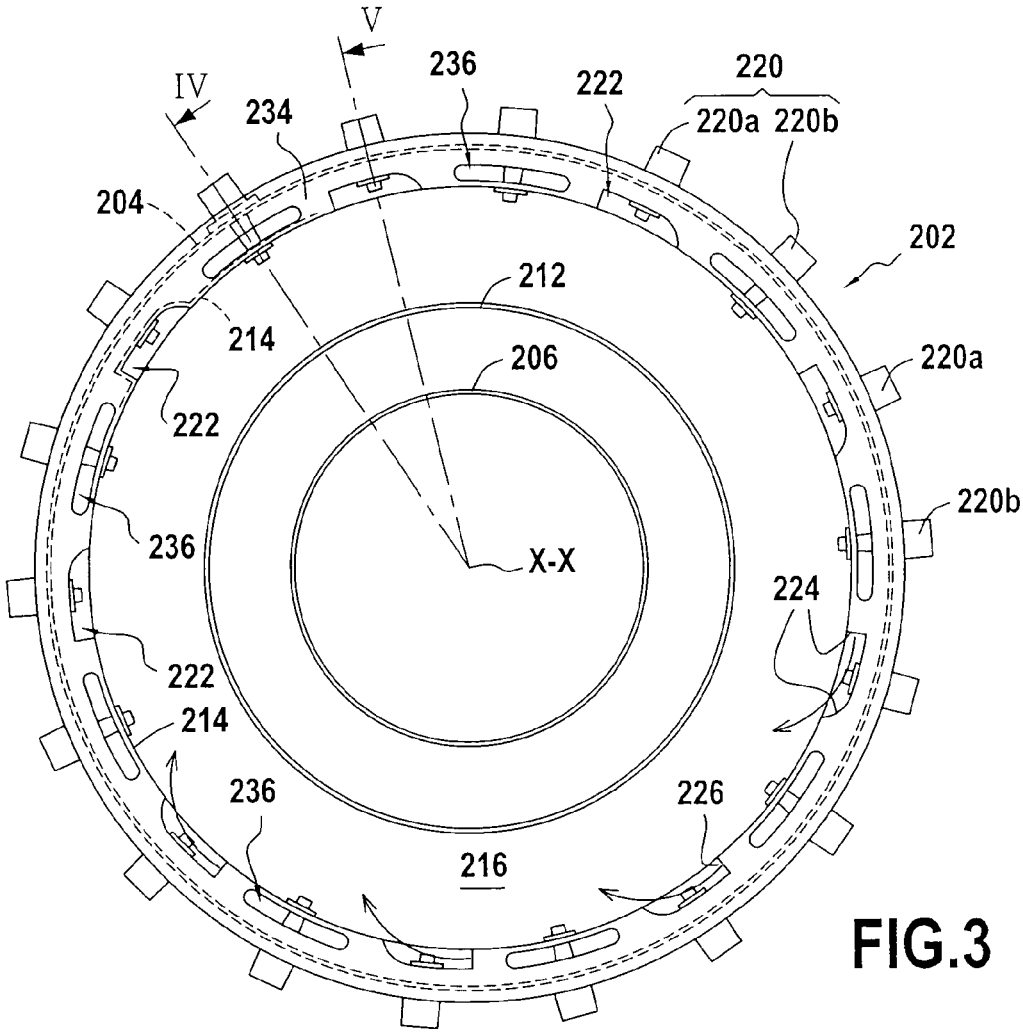
FIG.3
FIG.6
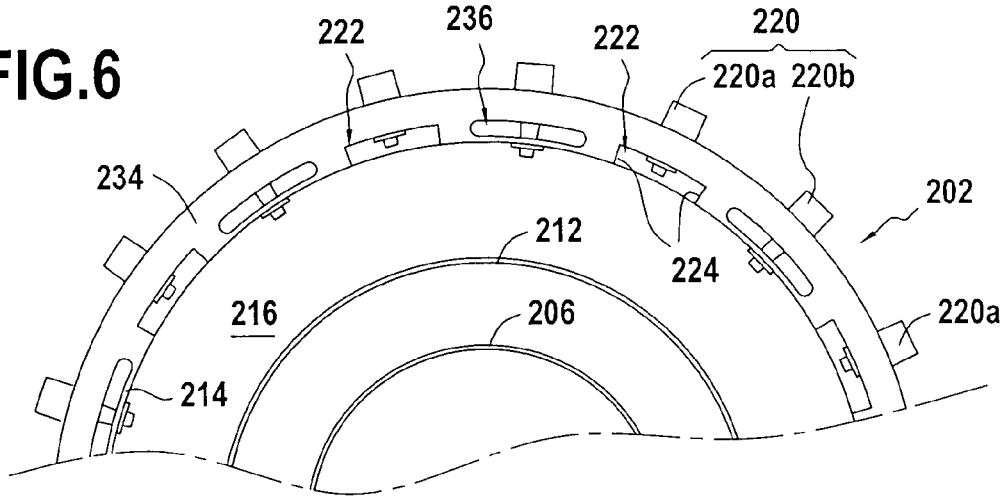

TURBOMACHINE COMBUSTION CHAMBER WITH HELICAL AIR FLOW

BACKGROUND OF THE INVENTION

The present invention relates to the general field of combustion chambers for an aviation or terrestrial turbomachine.

Typically, an aviation or terrestrial turbomachine comprises an assembly made up in particular of: an annular compression section for compressing the air that passes through the turbomachine; an annular combustion section located at the outlet from the compression section and in which the air coming from the compression section is mixed with fuel in order to be burnt therein; and an annular turbine section disposed at the outlet from the combustion section and having a rotor that is driven in rotation by the gas coming from the combustion section.

The compression section is in the form of a plurality of rotor wheel stages, each carrying blades that are located in an annular channel through which the turbomachine air passes and of section that decreases from upstream to downstream. The combustion section comprises a combustion chamber in the form of an annular channel in which the compressed air is mixed with fuel in order to be burnt therein. The turbine section is made up of a plurality of rotor wheel stages, each carrying blades that are located in an annular channel through which the combustion gas passes.

The flow of air through the above assembly generally takes place as follows: the compressed air coming from the last stage of the compression section possesses natural gyratory motion with an angle of inclination of the order of 35° to 45° relative to the longitudinal axis of the turbomachine, which angle of inclination varies as a function of the speed of the turbomachine (speed of rotation). At its inlet into the combustion section, this compressed air has its flow straightened to become parallel with the longitudinal axis of the turbomachine (i.e. the angle of inclination of the air relative to the longitudinal axis of the turbomachine is brought back to 0°) by means of air flow straightener vanes. The air in the combustion chamber is then mixed with the fuel so as to provide satisfactory combustion, and the gas produced by the combustion continues to flow generally along the longitudinal axis of the turbomachine so as to reach the turbine section. In the turbine section, the combustion gas is redirected by a nozzle so as to present gyratory motion with an angle of inclination greater than 70° relative to the longitudinal axis of the turbomachine. Such an angle of inclination is essential for producing the angle of attack needed to provide the mechanical force for imparting rotary drive to the rotor wheel of the first stage of the turbine section.

Such an angular distribution for the air passing through the turbomachine presents numerous drawbacks. The air that leaves the last stage of the compression section naturally presents an angle lying in the range 34° to 45° and its flow is successively straightened out (angle returned to 0°) on entering into the combustion chamber, and is then redirected to have an angle greater than 70° at its entry into the turbine section. Those successive changes to the angle of inclination of the air flow through the turbomachine require intense aerodynamic forces to be produced by the flow-straightener vanes of the compression section and by the nozzle of the turbine section, which aerodynamic forces are particularly harmful to the overall efficiency of the turbomachine.

OBJECT AND SUMMARY OF THE INVENTION

The present invention seeks to remedy the above-mentioned drawbacks by proposing a turbomachine combustion chamber that is capable of being fed with air that possesses rotary motion about the longitudinal axis of the turbomachine.

This object is achieved by a turbomachine combustion chamber comprising:

an inner annular wall about a longitudinal axis;

an outer annular wall centered on the longitudinal axis and surrounding the inner wall so as to co-operate therewith to define an annular space forming a combustion area; and a plurality of fuel injector systems comprising pilot injectors alternating circumferentially with full-throttle injectors;

the combustion chamber further comprising at least one air admission opening opening out into the upstream end of the combustion area in a direction that is substantially longitudinal;

wherein the outer wall includes a plurality of pilot cavities that are regularly distributed around the longitudinal axis, each pilot cavity extending longitudinally between the two longitudinal ends of the outer wall and radially towards the outside thereof, the pilot cavities being fed with air from outside the combustion chamber in a common substantially circumferential direction; and wherein each pilot injector opens out radially into a pilot cavity, and each full-throttle injector opens out radially between said adjacent pilot cavities.

The combustion chamber of the invention can be fed with air that possesses rotary motion about the longitudinal axis of the turbomachine. The natural angle of inclination of the air at the outlet from the compression section of the turbomachine can thus be maintained through the combustion chamber. As a result, the aerodynamic force required for imparting rotary drive to the first stage of the turbine section of the turbomachine is considerably reduced. This large reduction in the aerodynamic forces gives rise to increased efficiency for the turbomachine. In addition, both the flow-straightener vanes of the compression section and the nozzle of the turbine section can be simplified, or even eliminated, thereby presenting a saving in weight and a reduction in manufacturing costs.

Furthermore, the presence of pilot cavities, that are carburated solely for idling speeds of the turbomachine makes it possible to stabilize the combustion flame at all operating speeds of the turbomachine.

According to an advantageous disposition, each pilot cavity is closed at its upstream end and open at its downstream end.

According to another advantageous disposition, each pilot cavity is defined circumferentially by two substantially radial partitions, one of the partitions including a plurality of air injection orifices open to the outside of the combustion chamber and leading to said pilot cavity. Preferably, the other partition of each pilot cavity presents in cross-section, a section that is substantially curvilinear.

In yet another advantageous disposition, the full-throttle injectors are offset axially downstream relative to the pilot injectors. The flame coming from the pilot injectors requires a longer transit time in the combustion area than does the flame coming from the full-throttle injectors.

The combustion chamber need not have a wall transversely interconnecting the upstream longitudinal ends of the inner and outer walls. The absence of such a wall (referred to as the chamber end wall) makes it possible to preserve a maximum amount of the rotary motion of the air coming from the combustion section of the turbomachine.

According to yet another advantageous disposition, the fuel injector systems do not have associated air systems.

The combustion chamber may also include an inner annular fairing mounted on the inner wall extending the upstream end thereof, and an outer annular fairing mounted on the outer wall and extending the upstream end thereof.

The invention also provides a turbomachine including a combustion chamber as defined above.

BRIEF DESCRIPTION OF THE DRAWINGS

Other characteristics and advantages of the present invention appear from the following description with reference to the accompanying drawings that show an embodiment having no limiting character. In the figures:

FIG. 3 is a front view of the FIG. 2 combustion chamber;

FIG. 6 is a fragmentary front view of a combustion chamber in a variant embodiment of the invention.

DETAILED DESCRIPTION OF EMBODIMENTS

Figure 1:
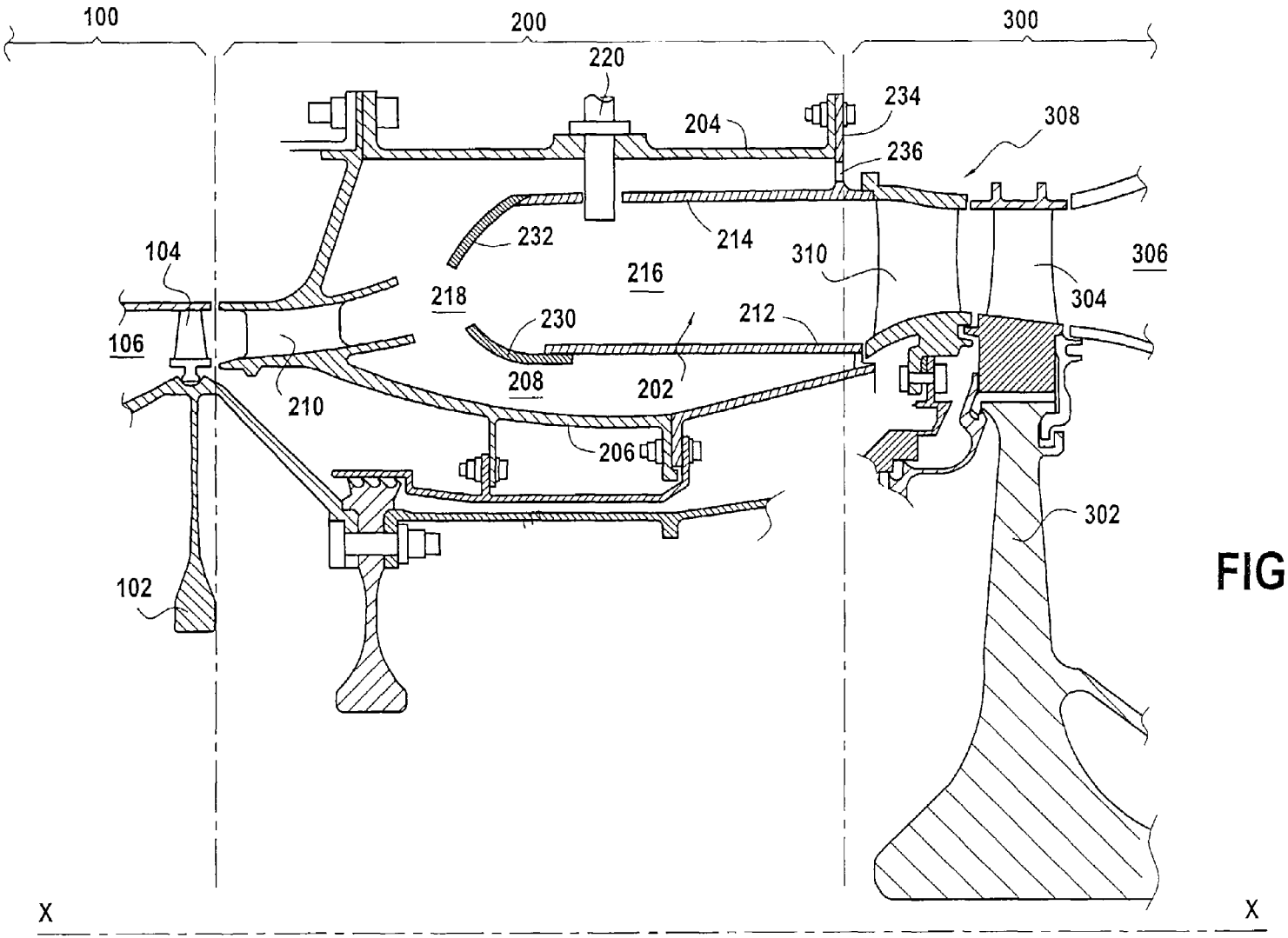
FIG. 1 is a fragmentary longitudinal section view of an aviation turbomachine fitted with a combustion chamber of the invention.

The turbomachine shown in part in FIG. 1 has a longitudinal axis X-X. Along this axis, it comprises in particular: an annular compression section 100; an annular combustion section 200 disposed at the outlet from the compression section 100 in the flow direction of the air passing through the turbomachine; and an annular turbine section 300 disposed at the outlet from the combustion section 200. Air injected into the turbomachine thus passes in succession through the compression section 100, then the combustion section 200, and finally the turbine section 3.

The compression section 100 is in the form of a plurality of rotor wheels 102 each carrying blades 104 (only the last stage of the compression section is shown in FIG. 1). The blades 104 of these stages are disposed in an annular channel 106 through which turbomachine air passes and of section that decreases going from upstream to downstream. Thus, as the air injected into the turbomachine passes through the compression section, it becomes more and more compressed.

The combustion section 200 is also in the form of an annular channel through which the compressed air coming from the compression section 100 is mixed with fuel in order to be burnt. For this purpose, the combustion section comprises a combustion chamber 202 within which the air/fuel mixture is burnt (this chamber is described in greater detail below).

The combustion section 200 also has a turbomachine casing constituted by an outer annular shroud 204 centered on the longitudinal axis X-X of the turbomachine, and an inner annular shroud 206 that is fastened coaxially inside the outer shroud. An annular space 208 formed between these two shrouds 204, 206 receives the compressed air coming from the compression section 100 of the turbomachine.

The turbine section 300 of the turbomachine is formed by a plurality of stages of rotor wheels 302, each carrying blades 304 (only the first stage of the turbine section is shown in FIG. 1). The blades 304 of these stages are placed in an annular channel 306 through which the gas coming from the combustion section 200 passes.

At the inlet to the first stage 302 of the turbine section 300, the gas coming from the combustion section needs to present an angle of inclination relative to the longitudinal axis X-X of the turbomachine that is sufficient to drive the various stages of the turbine section in rotation.

For this purpose, a nozzle 308 is mounted immediately downstream from the combustion chamber 202 and upstream from the first stage 302 of the turbine section 300. The nozzle 308 comprises a plurality of stationary radial vanes 310 of inclination relative to the longitudinal axis X-X of the turbomachine that enables the gas coming from the combustion section 200 to be given the angle of inclination that is needed for driving the various stages of the turbine section in rotation.

In conventional turbomachines, air passing in succession through the compression section 100, the combustion section 200, and the turbine section 300 is distributed as follows. The compressed air coming from the last stage 102 of the compression section 100 naturally possesses gyratory motion with an angle of inclination of about 35° to 45° relative to the longitudinal axis X-X of the turbomachine. By means of air flow straightener vanes 210 in the combustion section 200, this angle of inclination is returned to 0°. Finally, at the inlet to the turbine section 300, the gas coming from the combustion is redirected by the stationary vanes 310 of the nozzle 308 thereof in order to impart gyratory movement thereto with an angle of inclination relative to the longitudinal axis X-X that is greater than 70°.

According to the invention, a novel architecture is provided for the combustion chamber 202 that can be fed with air that possesses rotary motion around the longitudinal axis X-X of the turbomachine. By means of such an architecture, it is possible to conserve the natural angle of inclination of the compressed air coming from the last stage of the compression section without there being any need to straighten out the flow parallel to the longitudinal axis X-X. Similarly, it is no longer necessary for the stationary vanes 210 of the nozzle 308 in the turbine section 300 to present so great an angle of inclination in order to reduce the angle of attack needed for providing the mechanical force for imparting rotary drive to the rotor wheel 302 of the first stage of the turbine section.

For this purpose, the combustion chamber 202 of the invention has an inner annular wall 212 that is centered on the longitudinal axis X-X of the turbomachine, and an outer annular wall 204 that is likewise centered on the longitudinal axis X-X and that surrounds the inner wall so as to co-operate therewith to define an annular space 216 forming a combustion area.

The combustion chamber 202 of the invention also has at least one air admission opening 218 that opens out into the combustion area 216 at its upstream end and in a direction that is substantially longitudinal. The section of this air admission opening is adapted to ensure that the combustion area functions correctly.

More precisely, and as shown in FIG. 1, the combustion chamber is provided with a wall (chamber end wall) transversely interconnecting the upstream longitudinal ends of the inner and outer walls, with this air admission opening 208 being formed between the upstream ends of the inner and outer walls 212 and 214 of the combustion chamber.

The combustion chamber 202 of the invention also has a plurality of fuel injector systems 220 distributed around the outer wall 214 about the longitudinal axis X-X of the turbomachine and opening out into the combustion area 216 in a substantially radial direction.

Figure 2:
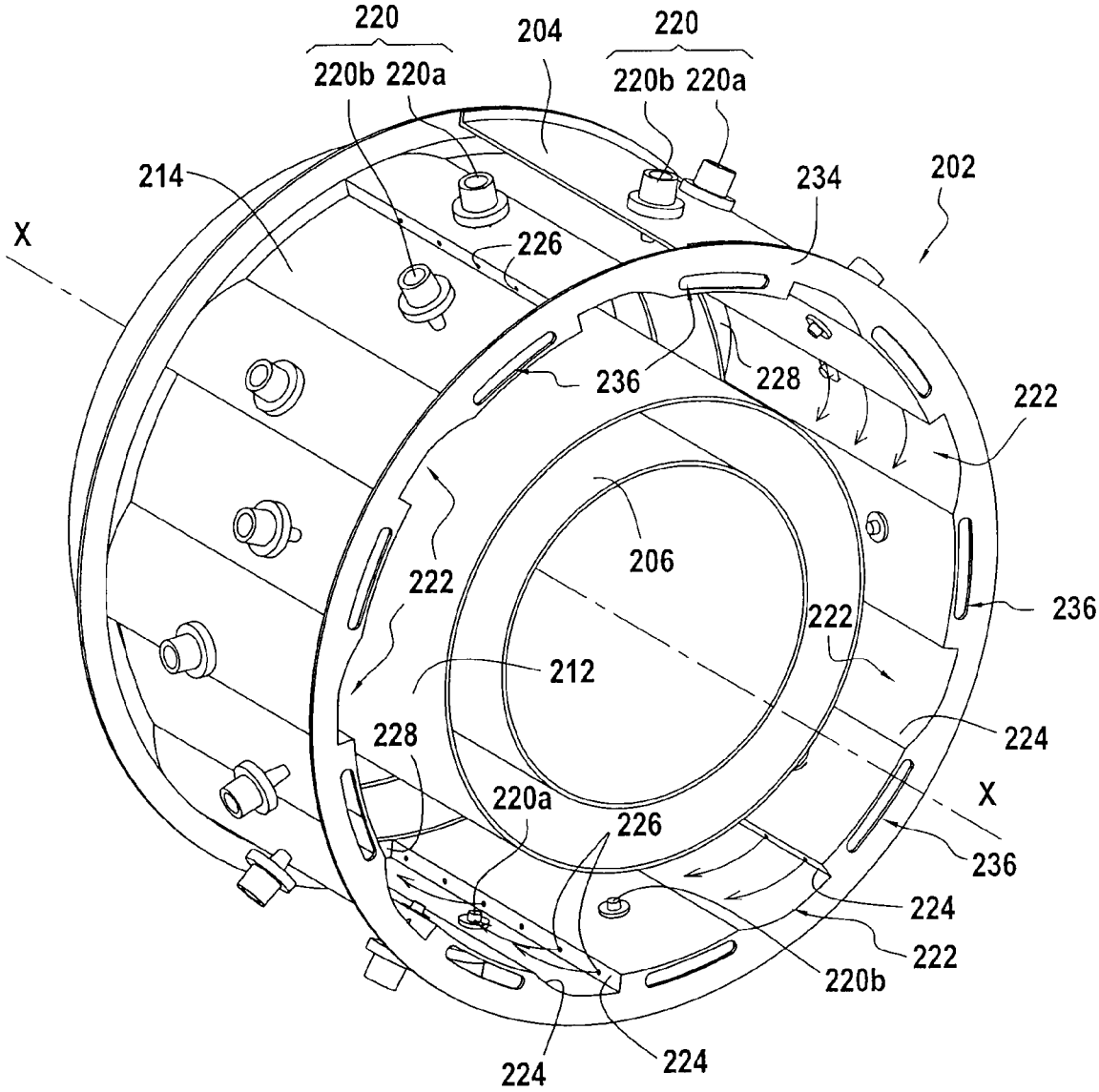
FIG. 2 is a perspective view of the FIG. 1 combustion chamber.
Figure 4:
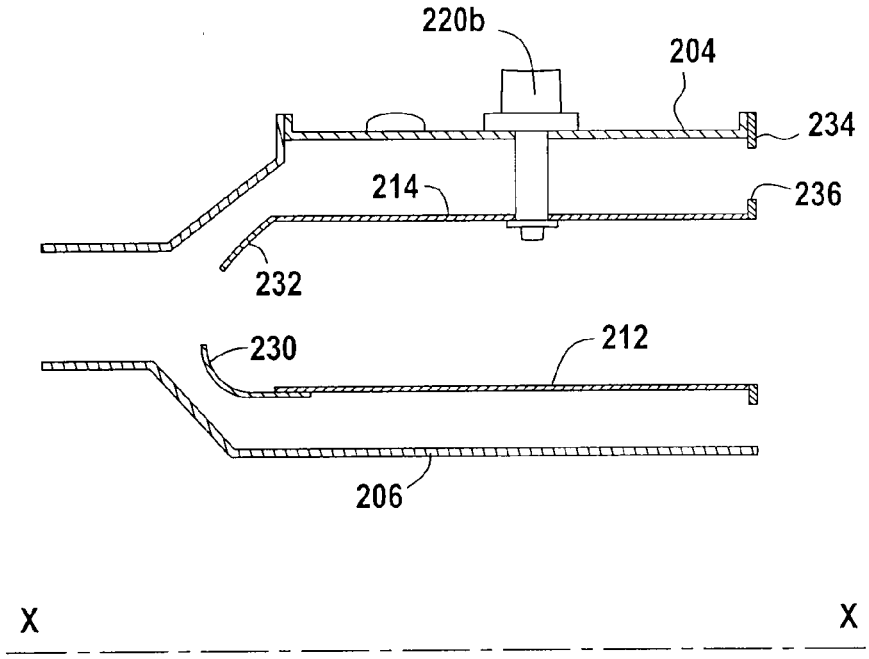
FIGS. 4 and 5 are section views on lines IV and V respective of FIG. 3.

As shown in FIGS. 2 and 3, the fuel injector systems 220 comprise pilot injectors 220*a* alternating circumferentially with full-throttle injectors 220*b*, the full-throttle injectors preferably being offset axially downstream relative to the pilot injectors.

Conventionally, the pilot injectors 220*a* serve for ignition purposes and also during idling of the turbomachine, while the full-throttle injectors 220*b* operate during stages of takeoff, climbing, and cruising. In general, the pilot injectors are fed with fuel continuously, whereas the takeoff injectors are fed only above a certain speed.

According to a particular advantageous characteristic of the invention, the fuel injector systems 220 do not have associated air systems such as air swirlers serving in known manner to generate a rotary flow of air within the combustion area for the purpose of stabilizing the combustion flame.

Thus, the pilot and full-throttle injectors of the combustion chamber are of very simple design and they operate very reliably since they perform their primary function only, i.e. they inject fuel. In addition, the pilot injectors 220*a* are of the same type as the full-throttle injectors 220*b*.

Still in accordance with the invention, the outer wall 214 of the combustion chamber has a plurality of pilot cavities 222 that are regularly distributed around the longitudinal axis X-X.

As shown in FIG. 2, each pilot cavity 222 extends firstly longitudinally between the two longitudinal ends (upstream and downstream) of the outer wall 214, and secondly radially towards the outside thereof. In other words, outer wall 214 is shaped to have a plurality of cavities 222 that project towards the outside of the wall.

Figure 5:
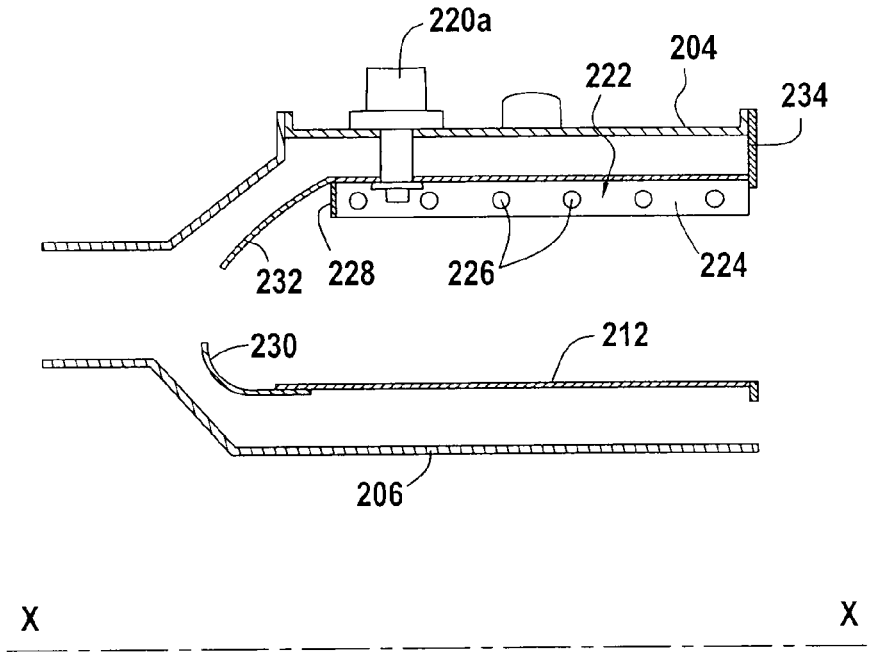

More precisely, each pilot cavity 222 is defined circumferentially by two partitions 224, each projecting radially outwards relative to the outer wall 214. As shown in FIGS. 2 and 5, one of these partitions presents a plurality of air injection orifices 226 that enable air outside the combustion chamber to be injected into the pilot cavity in a circumferential direction.

It should be observed that the air is injected circumferentially in the same direction of rotation (clockwise in the example of FIGS. 2 and 3) into all of the pilot cavities 222 of the combustion chamber. Furthermore, the direction of rotation used for circumferential injection of air into the pilot cavities is the same as the direction of rotation of the compressed air coming from the compression section of the turbomachine.

The pilot cavities 222 are fed with fuel via pilot injectors 220*a*, each opening out radially into one of the cavities. Each full-throttle injector 220*b* opens out radially into the combustion area between two adjacent pilot cavities.

Each pilot cavity 222 is preferably closed at its upstream end by a radial partition 228, and open at its downstream end (see in particular FIGS. 2 and 5). Thus, the air that penetrates into the combustion area 216 via its air admission opening 218 does not disturb the flow of air introduced into the pilot cavities 222 via the air injection orifices 226.

The combustion chamber operates as follows: the compressed air coming from the compression section 100 and in rotation about the longitudinal axis X-X penetrates into the combustion section 200. This air is split into two flows: an "internal" flow; and an "external" flow. The external flow goes around the combustion chamber 202 and feeds the pilot cavities 222 after cooling the outer wall 214 of the combustion chamber and the outer casing 204 of the combustion section. This outer air is injected into the pilot cavities via the air injection orifices 226 in the same direction of rotation as the direction of the air entering into the combustion section. In the pilot cavities, the air is mixed and burnt with the fuel injected via the pilot injectors 220*a*. The inner flow, which represents the major flow, penetrates into the combustion area 216 via the air admission opening 218 where it is mixed and burnt with the fuel injected by the full-throttle injectors 220*b*. The combustion flame is stabilized by the "carburation" of the pilot cavities.

Variant embodiments of the combustion chamber of the invention are described below.

In the embodiment of FIGS. 2 and 3, the longitudinal partition 224 of each pilot cavity that does not have air injection orifices presents, in cross-section, a section that is substantially curvilinear (unlike the other wall which is substantially plane). The curvature of these walls serves to accompany the rotary motion of the air injected into the pilot cavities via the air injection orifices 226.

In contrast, in the variant embodiment of FIG. 6, both of the longitudinal partitions 224 defining each pilot cavity 222 circumferentially are substantially plane, each extending in a radial direction.

In general, the number and the geometrical dimensions of the pilot cavities 222 in the combustion chamber can vary depending on requirements. The same applies to the number, the dimensions, and the positioning of the air orifices 226 into said cavities.

As shown in FIG. 1, the combustion chamber 202 may also have an inner annular fairing 230 that is mounted on the inner wall 212 extending the upstream end thereof, and also an outer annular fairing 232 that is mounted on the outer wall 214 extending the upstream end thereof. The presence of these fairings 230, 232 serves to control the flow rate of air penetrating into the combustion chamber 202 and the flow rate going round it.

Finally, the outer wall 214 of the combustion chamber may include at its downstream end an annular flange 234 projecting radially outwards from the wall, this flange being provided with a plurality of holes 236 that are spaced-apart regularly around the longitudinal axis X-X for the purpose of feeding cooling air to the turbine section 300.

What is claimed is:

1. A turbomachine combustion chamber comprising:

an inner annular wall about a longitudinal axis;

an outer annular wall centered on the longitudinal axis and surrounding the inner wall so as to co-operate therewith to define an annular space forming a combustion area; and a plurality of fuel injector systems comprising pilot injectors alternating circumferentially with full-throttle injectors;

the combustion chamber further comprising at least one air admission opening opening out into the upstream end of the combustion area in a direction that is substantially longitudinal;

wherein the outer wall includes a plurality of pilot cavities that are regularly distributed around the longitudinal axis, each pilot cavity extending longitudinally between the two longitudinal ends of the outer wall and radially towards the outside thereof, the pilot cavities being fed with air from outside the combustion chamber in a common substantially circumferential direction; and wherein each pilot injector opens out radially into a pilot cavity, and each full-throttle injector opens out radially between said adjacent pilot cavities.

2. A combustion chamber according to claim 1, in which each pilot cavity is closed at its upstream end and open at its downstream end.

3. A combustion chamber according to claim 1, in which each pilot cavity is defined circumferentially by two substantially radial partitions, one of the partitions including a plurality of air injection orifices open to the outside of the combustion chamber and leading to said pilot cavity.

4. A combustion chamber according to claim 3, in which the other partition of each pilot cavity presents in cross-section, a section that is substantially curvilinear.

5. A combustion chamber according to claim 1, in which the full-throttle injectors are offset axially downstream relative to the pilot injectors.

6. A combustion chamber according to claim 1, in which it does not have a wall transversely interconnecting the upstream longitudinal ends of the inner and outer walls.

7. A combustion chamber according to claim 1, in which the fuel injector systems do not have associated air systems.

8. A combustion chamber according to claim 1, further including an inner annular fairing mounted on the inner wall extending the upstream end thereof, and an outer annular fairing mounted on the outer wall and extending the upstream end thereof.

9. A turbomachine, including a combustion chamber according to claim 1.

10. A combustion chamber according to claim 1, in which the pilot fuel injectors and the full-throttle injectors open out into the combustion area in a substantially radial direction.

11. A combustion chamber according to claim 10, in which the pilot fuel injectors and the full-throttle injectors extend through the outer annular wall.

12. A combustion chamber according to claim 10, in which the pilot fuel injectors are arranged relative to said pilot cavities to mix and burn air in the pilot cavities with fuel injected from said pilot fuel injectors.

* * * * *